US008770936B1

(12) United States Patent
Liang

(10) Patent No.: US 8,770,936 B1
(45) Date of Patent: Jul. 8, 2014

(54) TURBINE BLADE WITH NEAR WALL COOLING CHANNELS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 415 days.

(21) Appl. No.: 12/951,584

(22) Filed: Nov. 22, 2010

(51) Int. Cl.
*F01D 5/18* (2006.01)

(52) U.S. Cl.
CPC ..... *F01D 5/186* (2013.01)
USPC ..... 416/97 R

(58) Field of Classification Search
USPC ..... 415/115, 116; 416/97 R, 97 A, 96 R, 416/96 A, 224, 226, 232
See application file for complete search history.

(56) References Cited

U.S. PATENT DOCUMENTS

| | | | | |
|---|---|---|---|---|
| 5,626,462 | A * | 5/1997 | Jackson et al. | 416/97 R |
| 6,264,428 | B1 * | 7/2001 | Dailey et al. | 416/97 R |
| 7,568,887 | B1 * | 8/2009 | Liang | 416/97 R |
| 2005/0260076 | A1 * | 11/2005 | Daux et al. | 416/97 R |

* cited by examiner

*Primary Examiner* — Ned Landrum
*Assistant Examiner* — Woody A Lee, Jr.
(74) *Attorney, Agent, or Firm* — John Ryznic

(57) ABSTRACT

A turbine rotor blade with a thin thermal skin bonded over a spar to enclose serpentine flow cooling channels that extend from a platform to a blade tip along the airfoil walls. The radial channels discharge into a collection cavity and then flow through exit holes in the trailing edge. The radial cooling channels are formed as semi-circular shaped channels to maximize surface area on the hot side wall and on the cold side wall of the spar.

8 Claims, 3 Drawing Sheets

TURBINE BLADE WITH NEAR WALL COOLING CHANNELS

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to a turbine rotor blade with near wall cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

One prior art turbine blade cooling design is shown in FIGS. 1 and 2 which uses near wall radial flow cooling channels formed within the walls of the airfoil. Cooling air flows into each radial flow channel from the bottom and through a number of cooling air resupply holes that connect to a central cavity. Cooling air flows through the radial flow channels to produce near wall cooling of the walls and then discharged through film cooling holes to produce a layer of film air on the external wall surface. In the FIG. 1 blade cooling design, the spanwise and chordwise cooling flow control due to the airfoil external hot gas temperature and pressure variations is difficult to achieve. Surfaces of the airfoil vary in temperature and pressure and therefore require controlled air flow pressure and volume to control metal temperature.

BRIEF SUMMARY OF THE INVENTION

A turbine rotor blade with a thin thermal skin bonded to a spar to form an airfoil for the blade. The spar forms a central cooling air collection cavity between the walls with two-pass serpentine flow cooling channels formed on an outer surface that extends in a radial direction. The thin thermal skin is bonded to the spar to enclose these radial serpentine flow channels. Cooling air flows through the semi-circular shaped radial flow channels first toward the tip and then turns and flows toward the root where the cooling air is then discharged into the collection cavity and then flows through exit holes on the trailing edge of the airfoil.

DETAILED DESCRIPTION OF THE INVENTION

Figure 1:
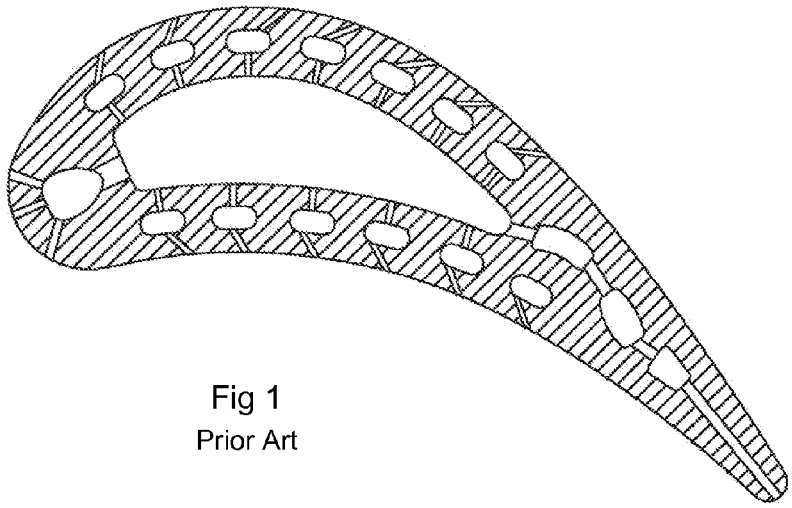
Fig 1 Prior Art
FIG. 1 shows a cross section top view of a prior art near wall cooled turbine blade.
Figure 2:
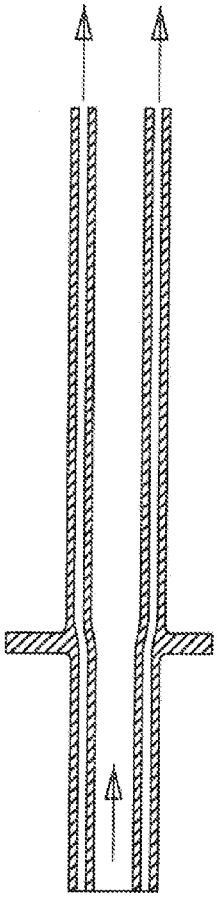
Fig 2 Prior Art
FIG. 2 shows a cross section side view of the prior art blade of FIG. 1.
Figure 3:
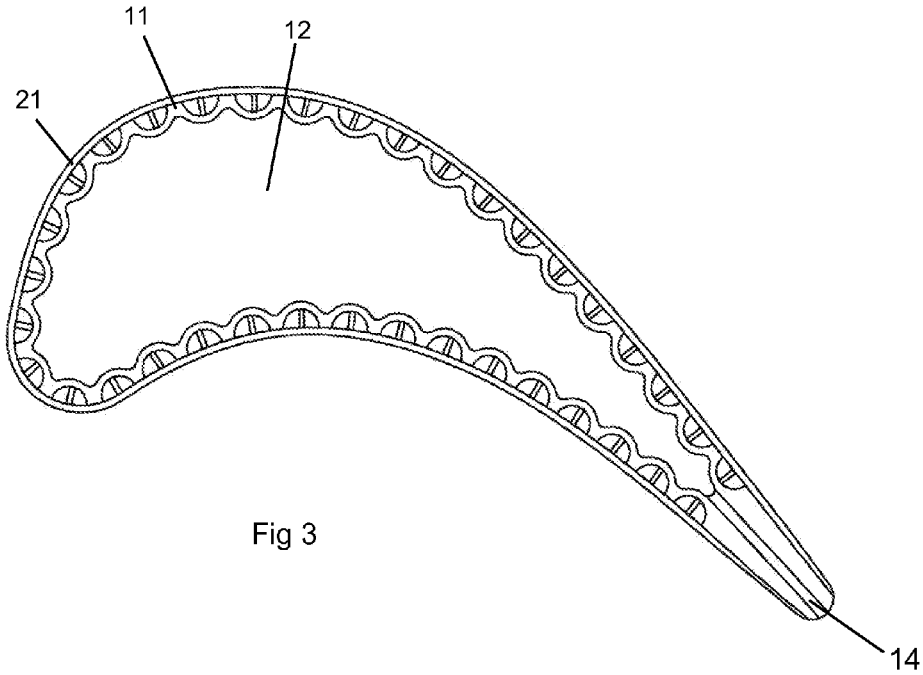
FIG. 3 shows a cross section top view of the near wall radial flow cooling circuit for the blade of the present invention.

A turbine rotor blade for a gas turbine engine with radial near wall cooling passages formed within a spar that is covered by a thin thermal skin to enclose the radial passages and to form the outer airfoil surface of the blade. FIG. 3 shows a cross section view of the airfoil with the spar 11 having a general airfoil shape with a leading edge and a trailing edge and a pressure side wall and a suction side wall extending between the two edges. The spar 11 forms a cooling air collection cavity 12 that extend from the leading edge to the trailing edge region. In another embodiment, the single collection cavity can be formed as separate cavities by ribs extending from the P/S wall to the S/S wall. A row of exit holes 14 is located at the trailing edge and connected to the collection cavity 12. A thin thermal skin 21 is bonded to the outer surface of the spar to enclose the radial cooling channels.

Figure 4:
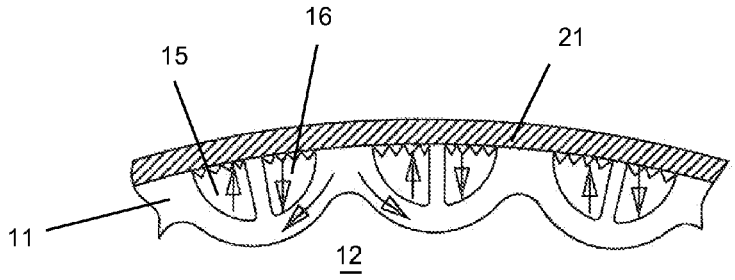
FIG. 4 shows a detailed cross section view of a section of the wall with the semi-circular shaped radial flow cooling channels of the present invention.
Figure 5:
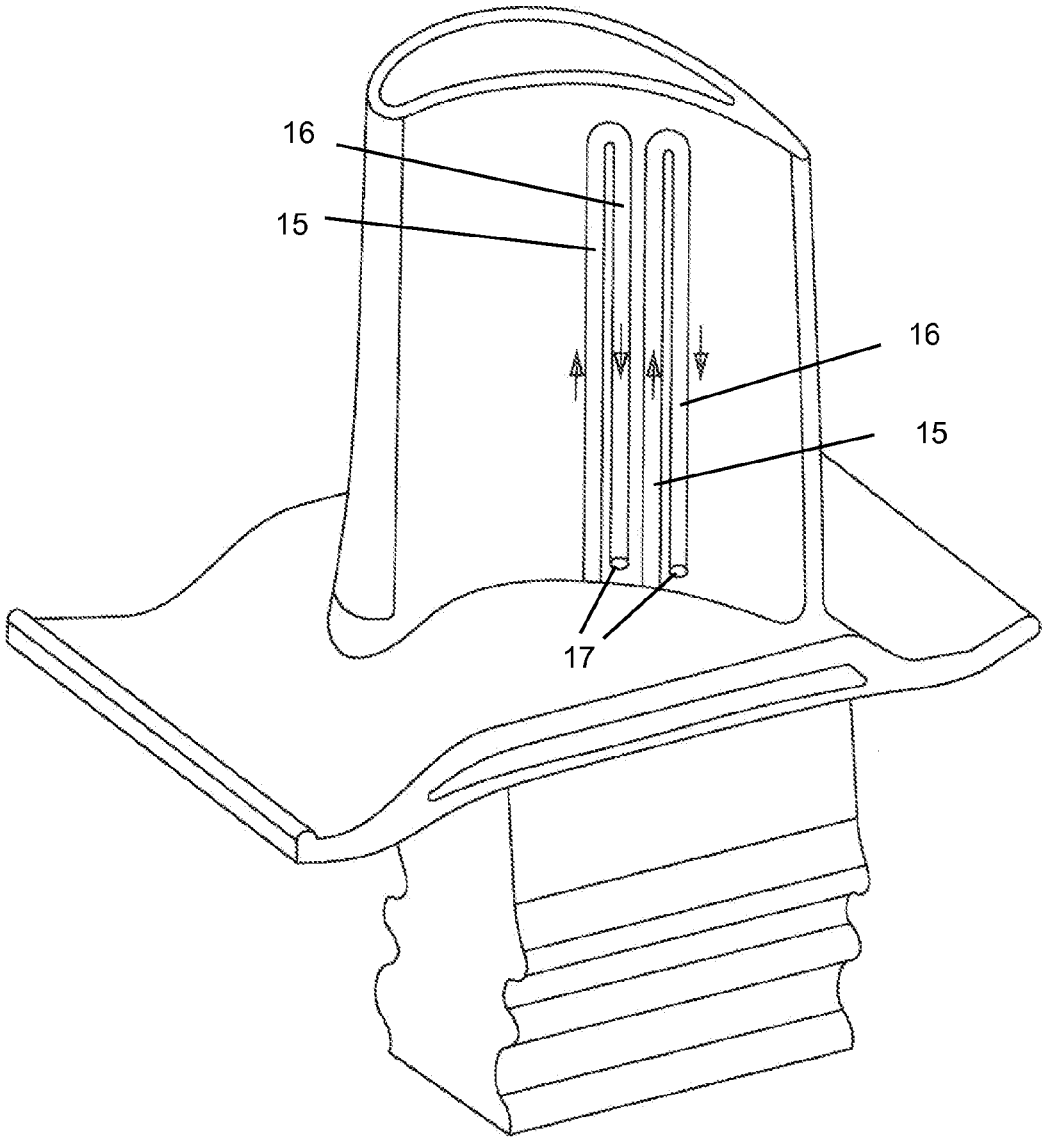
FIG. 5 shows a profile view of the blade of the present invention with two of the serpentine flow radial cooling channels of the present invention.

FIG. 4 shows a detailed view of a section of the airfoil wall with the thermal skin 21 bonded over the spar 11. The radial cooling channels are formed on the outer surface of the spar and include a first or upward flowing radial cooling channel 15 and a second or downward flowing radial cooling channel 16 connected to the upward flowing channel 15 by a turn passage located adjacent to the blade tip. Each radial cooling channel 15 and 16 are formed as semi-circular cooling channels as seen in FIG. 4. An inner surface of the thermal skin 21 includes rough wall surfaces in the channels to function like trip strips to enhance the heat transfer affect of the cooling air passing through the channels. The radial cooling channels 15 and 16 extend from the platform to the blade tip as seen in FIG. 5 and extend all around the airfoil as seen in FIG. 3 to provide near wall cooling for the airfoil. The second or downward flowing radial channel discharges into the collection cavity 12 through holes 17 at the end of the radial channel 16.

The multiple serpentine flow cooling channels have a semi-circular shape for a maximum open flat section that faces to hot surface of the airfoil wall for maximum cooling capability. The backing surface is at a quarter circular shaped in order to maximize the heat conduction to the cold side surface of the spar and therefore minimize a thermal gradient between the hot wall outer surface and the cold inner wall surface of the spar. With this design, a maximum usage of cooling air for a given airfoil inlet gas temperature is achieved for a longer blade LCF (Low Cycle Fatigue) life.

For the construction of the spar and thermal skin blade, the spar can be cast using an investment or lost wax casting process with the radial passages formed on the outer surface along with the collection cavity. The multiple radial flow channels can be cast with the spar or machined into the spar after casting. The thin thermal skin is then bonded over the spar to enclose the radial channels using a transient liquid phase (TLP) bonding process. The thin thermal skin can be one piece or formed as several pieces. The thermal skin can be formed from a high temperature material in a thin sheet metal form. The rough surfaces on the backside can be formed by a photo or chemical etching process. The thickness of the thin thermal skin is in a range of 0.010 to 0.030 inches to provide effective near wall cooling and keep the thermal skin temperature much lower than the hot gas stream temperature. This manufacture process for the blade will eliminate all of the constraints imposed on a blade formed by the casting process of a near wall cooled blade that uses mini-core ceramic for casting the cooling passages.

In operation, cooling air is supplied through the airfoil mid-chord cavity below the blade platform and into the first or upward flowing radial cooling channels, flows upward toward the tip and then turns down and into the second or downward flowing radial cooling channels. The roughened surfaces on the backside of the thermal skin in the channels will enhance the heat transfer rate from the hot wall surface to the cooling air flow. The cooling air from the second channels then flows into the collection cavity and finally flows through the exit holes on the trailing edge to provide cooling for the trailing edge region. The radial upward flowing and downward flowing channels form a counter flow heat transfer affect. The cooler inlet cooling air flow will be countered by the warmer returning cooling air which will lower a thermal gradient for the serpentine flow cooling channels to achieve a thermally balanced airfoil cooling design.

I claim:

1. A turbine rotor blade comprising:

a spar forming a cooling air collection cavity on an inside and a number of serpentine radial flow cooling channels on an outer surface;

a thin thermal skin bonded to the outer surface of the spar to enclose the serpentine radial flow cooling channels;

a row of exit holes on the trailing edge connected directly to the cooling air collection cavity;

the radial flow cooling channels have a semi-circular shape with a flat face against the thin thermal skin; and, the upward flowing channel and the downward flowing channel form a half-circular shape with a rib separating the two channels.

2. The turbine rotor blade of claim 1, and further comprising:

the serpentine radial flow cooling channels are two-pass serpentine flow channels with a first channel being an upward flowing channel and a second channel being a downward flowing channel.

3. The turbine rotor blade of claim 1, and further comprising:

an inner surface of the spar that forms the semi-circular radial flow cooling channels has a semi-circular shape.

4. The turbine rotor blade of claim 1, and further comprising:

the serpentine radial flow cooling channels extend from a platform to a tip of the blade.

5. The turbine rotor blade of claim 1, and further comprising:

the serpentine radial flow cooling channels discharge into the collection cavity.

6. The turbine rotor blade of claim 1, and further comprising:

the thin thermal skin has a roughened surface on a side forming the enclosed radial cooling channels.

7. The turbine rotor blade of claim 1, and further comprising:

the serpentine radial flow cooling channels extends from a trailing edge region along the pressure side wall and suction side wall and around the leading edge region of the blade.

8. The turbine rotor blade of claim 1, and further comprising:

the thin thermal skin has a thickness of 0.010 to 0.030 inches.

* * * * *